US009371749B2

(12) United States Patent
Hegemier et al.

(10) Patent No.: US 9,371,749 B2
(45) Date of Patent: Jun. 21, 2016

(54) HYBRID VALVE STEM SEAL RETAINER ASSEMBLY

(71) Applicants: Timothy A. Hegemier, Avila, IN (US); Alexander S. Williamson, Fort Wayne, IN (US); Robert W. Lehmann, Fort Wayne, IN (US)

(72) Inventors: Timothy A. Hegemier, Avila, IN (US); Alexander S. Williamson, Fort Wayne, IN (US); Robert W. Lehmann, Fort Wayne, IN (US)

(73) Assignee: Dana Automotive Systems Group, LLC, Maumee, OH (US)

( * ) Notice: Subject to any disclaimer, the term of this patent is extended or adjusted under 35 U.S.C. 154(b) by 0 days.

(21) Appl. No.: 13/757,285

(22) Filed: Feb. 1, 2013

(65) Prior Publication Data

US 2013/0200574 A1 Aug. 8, 2013

Related U.S. Application Data

(60) Provisional application No. 61/596,267, filed on Feb. 8, 2012.

(51) Int. Cl.
*F02F 11/00* (2006.01)
*F01L 3/08* (2006.01)

(52) U.S. Cl.
CPC ..... *F01L 3/08* (2013.01)

(58) Field of Classification Search
CPC ..... F16J 15/3252; F16J 15/16; F16J 15/164; F01L 3/08
USPC ..... 277/502, 500
See application file for complete search history.

(56) References Cited

U.S. PATENT DOCUMENTS

| | | | | |
|---|---|---|---|---|
| 3,498,621 | A | 3/1970 | Wilson | |
| 3,554,180 | A | 1/1971 | Lesser | |
| 4,198,062 | A | 4/1980 | Grsesiak | |
| 4,531,483 | A | 7/1985 | Vossieck | |
| 4,773,363 | A | 9/1988 | Stritzke | |
| 4,811,704 | A | 3/1989 | Boehmer | |
| 4,811,960 | A | 3/1989 | Stritzke | |
| 4,947,811 | A | 8/1990 | Binford | |
| 4,993,379 | A | 2/1991 | Viazzi | |
| 5,062,397 | A | 11/1991 | Larson | |
| 5,237,971 | A * | 8/1993 | Worsley | 277/502 |
| 5,295,461 | A | 3/1994 | Rao | |
| 5,558,056 | A | 9/1996 | Sakata | |
| 6,123,054 | A | 9/2000 | Netzer | |
| 6,202,616 | B1 | 3/2001 | Gracyalny | |
| 6,209,504 | B1 | 4/2001 | Hegemier | |

(Continued)

FOREIGN PATENT DOCUMENTS

| | | |
|---|---|---|
| DE | 1243934 | 7/1967 |
| DE | 9308125 | 8/1993 |

(Continued)

*Primary Examiner* — Kristina Fulton
*Assistant Examiner* — Nathan Cumar
(74) *Attorney, Agent, or Firm* — Marshall & Melhorn, LLC

(57) ABSTRACT

A valve stem seal assembly has a metal retainer, an elastomeric seal, and a metal valve guide. The metal retainer and the elastomeric seal are attached to each other, and the elastomeric seal is in sealable contact with the metal valve guide, while the metal retainer is in metal-to-metal gripping contact with the metal valve guide. A stop may be formed in the metal retainer that cooperates with a shoulder formed in the metal valve guide in order to prevent over-installation of the assembly of the elastomeric seal with attached metal retainer, when this assembly is installed over the metal valve guide.

13 Claims, 2 Drawing Sheets

(56) References Cited

U.S. PATENT DOCUMENTS

| | | | | |
|---|---|---|---|---|
| 6,227,548 | B1 | 5/2001 | Netzer | |
| 6,230,679 | B1 | 5/2001 | Hegemier | |
| 6,244,235 | B1 | 6/2001 | Hegemier | |
| 6,318,328 | B1 | 11/2001 | Hegemier | |
| 6,394,463 | B1 | 5/2002 | Otani | |
| 6,450,143 | B1 | 9/2002 | Hegemier | |
| 6,609,700 | B2 * | 8/2003 | Leimer | 251/214 |
| 6,764,079 | B1 | 7/2004 | Hgeemier | |
| 6,877,719 | B2 | 4/2005 | Heinl | |
| 6,901,902 | B1 | 6/2005 | Butcher | |
| 6,938,877 | B2 | 9/2005 | McArthy | |
| 7,025,030 | B2 | 4/2006 | Leimer | |
| 7,328,679 | B2 | 2/2008 | Ihara | |
| 7,654,537 | B2 * | 2/2010 | Scarano | 277/502 |
| 7,862,048 | B2 | 1/2011 | Scarano | |
| 8,011,669 | B2 | 9/2011 | Sakata | |
| 8,235,394 | B2 | 8/2012 | Sakata | |
| 8,246,006 | B2 | 8/2012 | Leimer | |
| 8,668,203 | B2 | 3/2014 | Sakata | |
| 8,893,681 | B2 | 11/2014 | Sakata | |
| 2002/0179877 | A1 * | 12/2002 | Leimer | 251/214 |
| 2003/0160394 | A1 | 8/2003 | Martelli | |
| 2006/0027977 | A1 * | 2/2006 | Leimer et al. | 277/502 |
| 2007/0022997 | A1 | 2/2007 | Lantelme | |
| 2009/0256315 | A1 | 10/2009 | Hamamoto | |
| 2010/0084821 | A1 * | 4/2010 | Scarano | 277/502 |
| 2013/0082203 | A1 | 4/2013 | Kurth | |
| 2013/0200574 | A1 | 8/2013 | Hegemier | |
| 2014/0130766 | A1 | 5/2014 | Sakata | |

FOREIGN PATENT DOCUMENTS

| | | |
|---|---|---|
| DE | 102009016016 | 10/2010 |
| EP | 392893 | 10/1990 |
| EP | 2236867 | 10/2010 |
| JP | 202181199 | 6/2002 |
| JP | 4734712 | 7/2011 |

* cited by examiner

HYBRID VALVE STEM SEAL RETAINER ASSEMBLY

RELATED APPLICATION

This application claims the benefit under 35 U.S.C. §119 (e) of U.S. Provisional Patent Application Ser. No. 61/596,297, filed Feb. 8, 2012, which is incorporated by reference herein in its entirety.

FIELD OF THE INVENTION

The present invention relates to a valve stem seal retainer assembly. More particularly, the present invention relates to a valve stem seal retainer assembly utilizing an elastomeric-to-metal seal area and a metal-to-metal grip area with a valve guide.

BACKGROUND OF THE INVENTION

For a vehicle, a valve stem seal assembly cooperates with a reciprocating valve stem shaft to provide lubrication and contain engine gases within engine inlet and exhaust ports (not shown). To accomplish these functions, the valve stem seal assembly typically includes an elastomeric seal with an attached metal retainer that is installed over a metal valve guide.

Such a valve stem seal assembly takes advantage of an elastomeric-to-metal seal between the elastomeric seal and the valve guide or a metal-to-metal grip between the retainer and the valve guide.

FIG. 1 illustrates a prior art side seal valve stem assembly 10. An elastomeric seal 12, with a garter spring 14 disposed thereon, are utilized to seal a valve stem shaft 16 of the valve stem assembly 10. A retainer 18, which is disposed within and on an outer surface 20 of the elastomeric seal 12, cooperates with the elastomeric seal 12, to seal a valve guide 22 at a single elastomeric-to-metal seal area 24.

FIG. 2 illustrates a prior art top seal valve stem assembly 30. An elastomeric seal 32, with a retainer 34 disposed thereto, are utilized to seal the valve stem shaft 36 at the top of the valve stem assembly 30. The retainer 34, in this case, is utilized to directly grip a valve guide 38 at a single metal-to-metal grip area 26.

Lately, however, manufacturers are requiring engines to have higher pressures within their inlet and exhaust ports. As a result, valve stem seals, like those in FIGS. 1 and 2, are being exposed to increased lifting forces, which in turn require the seals 12, 32 to resist being pushed off of the valve guides 22, 38 by these forces. As a result of these recent developments, past valve stem seals are not capable of sustaining the increased lifting forces. In many cases, because of its elastomeric characteristics, the elastomeric seal material fails to retain the seal, which results in loss of lubrication control and engine gases escaping through the valve stem and guide interface (not shown).

In response, elastomeric seal manufacturers are increasing the seal to guide interference of the elastomeric material. Unfortunately, increasing the seal to guide interference of the elastomeric seal then requires the seal to be installed with a greater installation load (i.e., force) which quite often results in over-installing the elastomeric seal or cutting the elastomer during initial installation or during cylinder head servicing. In either of these cases, the valve stem seal assembly fails to function properly.

With the increased pressures within the inlet and exhaust ports and the over-installation of the elastomeric seal in mind, what is sought is to take advantage of the increased seal ability of the elastomeric seal while further taking advantage of the metal grip ability of the retainer. By utilizing these advantages, a means to overcome the over-installation of the elastomeric seal is also sought.

SUMMARY OF THE INVENTION

A valve stem seal assembly comprises an elastomeric seal, a metal retainer disposed within a side of the elastomeric seal, and a metal valve guide. The metal valve guide is in an elastomeric-to-metal seal with the elastomeric seal on a side of the metal valve guide. Also, the metal valve guide is in a metal-to-metal grip with the metal retainer, which has a stop formed therein. The stop is in a block contact with a shoulder on the metal valve guide to prevent over-installation of the assembly of an elastomeric seal with attached retainer.

In addition, another valve stem seal assembly comprises an elastomeric seal and a metal retainer that has first and second inward vertical surfaces, with a continuous metal retainer stop therebetween. The elastomeric seal is disposed on the first inward vertical surface of the metal retainer at a top of a valve stem seal assembly where the elastomeric seal is in an elastomeric-to-metal seal with the metal retainer. Further, a metal valve guide has first and second outward vertical surfaces, where the second outward vertical surface of the metal valve guide is in a metal-to-metal grip with the second inward vertical surface of the metal retainer, from the bottom of the continuous metal retainer stop down to the bottom of the metal retainer.

Further advantages will be apparent from the following description and appended claims, reference being made to the accompanying drawings forming a part of a specification, wherein like reference characters designate corresponding parts of several views.

DETAILED DESCRIPTION OF THE INVENTION

It is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions, directions or other physical characteristics relating to the embodiments disclosed are not to be considered as limiting, unless the claims expressly state otherwise.

The present invention is founded upon the premise of two separate functions associated with a valve stem seal assembly: a) better sealing a metal valve guide and b) retaining an elastomeric valve seal with retainer on a metal valve guide, so as to maintain the pressure and engine gases within an inlet or exhaust port. It has been found that using both the elastomeric valve seal to seal and a metal retainer to grip, the elastomeric valve seal takes advantage of each of these items material strengths while avoiding their weaknesses. Also, by a use of a stop on the metal retainer, in conjunction with a complementary shoulder on the metal valve guide, over installation of the elastomeric valve seal on the metal valve guide is prevented. In addition, the stop keeps the metal valve guide from making contact with unintended portions of the elastomeric valve seal that can distort, for example, the sealing contact made by the seal with a valve stem shaft.

Figure 3:
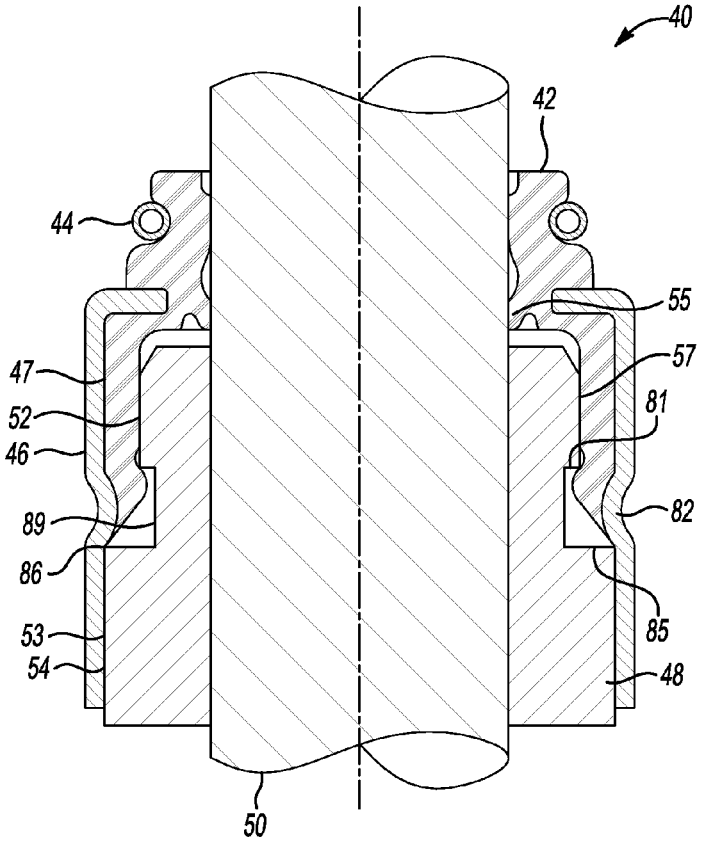
FIG. 3 is a cross sectional elevation view of a side seal valve stem seal assembly in accordance with the present invention.

FIG. 3 illustrates a side seal valve stem seal assembly 40 comprising an elastomeric seal 42 (comprised of, for example, a fluoroelastomer, abbreviated FKM), a biasing member 44 (such as a garter spring as shown in FIG. 3), a metal retainer 46, and a metal valve guide 48, which cooperate with a valve stem shaft 50, so as to better seal the metal valve guide 48, to retain the elastomeric seal 42 with the retainer 46 on the metal valve guide 48, and to maintain the pressure and engine gases within an inlet or exhaust port (not shown).

In general, the configuration of an upper portion 45 (i.e., that vertical area between the top of the seal 42, where the reference line for item 42 is pointing, and where the reference line for the sealing lip 55 is pointing) of the present invention side seal assembly 40 can be of any form, for example, unsupported, R-ring, garter spring, Allbond (trademark of Dana Corporation), etc. This assembly 40 can also be of any style, for example, multi-lip, radius lip, square lip, gas lip, etc.

Further, an upper portion of the metal retainer 46 is defined to be where the metal retainer 46 is horizontally molded into the side of the elastomeric seal 42, just below the garter spring 44 of the elastomeric seal 42. At the garter spring 44, there is a force horizontally applied radially inward on the seal 42 to better seal the seal 42 to the valve stem shaft 50. In addition, the seal 42 is attached by way of an adhesive (common in the art) to a first inward vertical surface 47 of the metal retainer 46, where the first inward vertical surface 47 is located above a stop 82. Further, the assembly 40 provides an elastomeric-to-metal seal between the seal 42 and a valve guide first upper outward vertical surface 52, which is the uppermost vertical surface of the metal valve guide 48 and which is located above the stop 82. It is noted that the designations in the present "Detailed Description," of first, second, third, etc., as applied to the various surfaces of the elements of FIGS. 3 and 4, may differ from the designations in the present "Claims," of first, second, third, etc., as applied to those same surfaces of the elements of FIGS. 3 and 4.

The assembly 40 provides a metal-to-metal grip between a metal retainer second inward vertical surface 53 and a metal valve guide second outward vertical surface 54, where both vertical surfaces 53, 54 are located below the stop 82.

Consequently, the valve stem seal assembly 40 seals and grips the metal valve guide 48 with two surfaces 52, 54 in contact with corresponding retainer surfaces 57, 53. Hence, these two surfaces 52, 54 of the metal valve guide 48 take advantage of the elastomeric characteristics of the seal 42 to seal and the metal characteristics of the retainer 46 to grip the metal valve guide 48.

As a result of the valve stem seal assembly 40, high pressure gases within the vehicle inlet and exhaust ports (not shown) do not pass by the metal valve guide 48, because the valve guide 48 is strongly sealed by the seal 42 and gripped by the retainer 46, so as to maintain the high pressure and engine gases within the inlet and exhaust ports.

Figure 4:
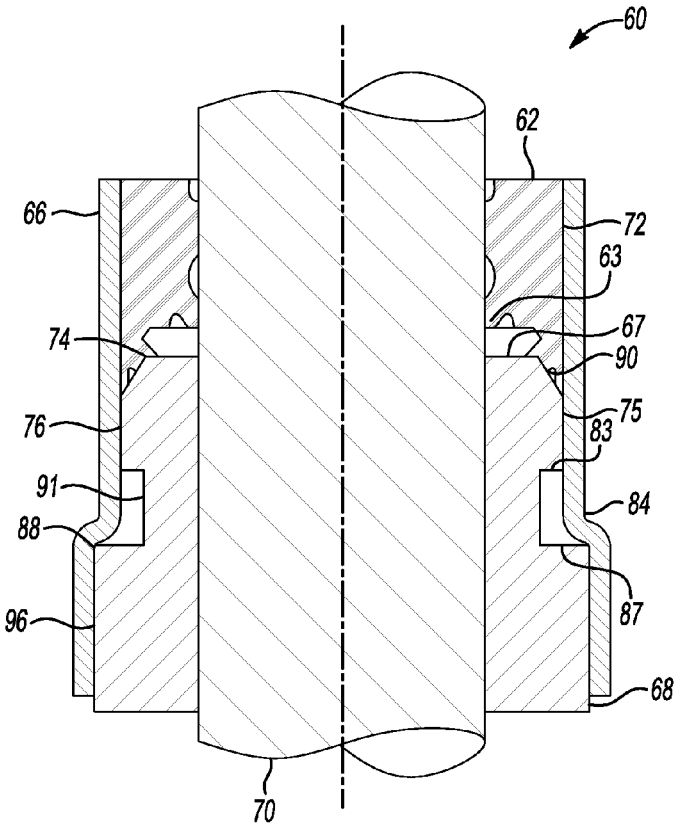
FIG. 4 is a cross sectional elevation view of a top seal valve stem seal assembly in accordance with the present invention.

FIG. 4 illustrates a top seal valve stem seal assembly 60 comprising an elastomeric seal 62 (comprised of, for example, a fluoroelastomer, abbreviated FKM), a metal retainer 66, and a metal valve guide 68, which cooperate with the valve stem shaft 70.

The elastomeric seal 62 is disposed, for example, by way of an adhesive (common in the art), on a first inward vertical surface 72 of the metal retainer 66 at a top (i.e., from where the reference line 62 is pointing to the stop 84) of the valve stem seal assembly 60. A radially inwardly directed force is applied by the metal retainer 66 on the elastomeric seal 62 to seal the elastomeric seal 62 to a valve stem shaft 70, when a press-fit assembly of these parts 62, 66 is made to the valve stem shaft 70.

The metal valve guide 68 is in an elastomeric-to-metal seal with the elastomeric seal 62, at the top 67 of the metal valve guide 68, where a lower extension 74 of the seal 62 seals an upper outward chamfer surface 90 on a top corner of the valve guide 68. Also shown is the metal retainer 66 being in a first metal-to-metal grip, which may be optional, with the metal valve guide 68 between the first retainer inward vertical surface 75 and the first valve guide outward vertical surface 76, which extends from the bottom of the upper outward chamfer surface 90 to an upper horizontal surface 83 of the metal valve guide 68.

Consequently, the valve stem seal assembly 60 seals/grips the metal valve guide 68 off in at least two areas, i.e., the seal extension 74 and the vertical grip surfaces 75, 76, instead of the single grip area 26, as prior art valve stem seal assembly 30 provides. Hence, this double sealing/grip of the metal valve guide 68 is accomplished while taking advantage of both the elastomeric characteristics of the seal 62 to seal and the metal characteristics of the retainer 66 to grip the valve guide 68.

As a result of the structure of the valve stem seal assembly 60, the gases, which are under high pressure within the inlet and exhaust ports, do not pass by the metal valve guide 68, because the valve guide 68 is strongly sealed by the seal 62 and also gripped at vertical surfaces 75, 76 between the retainer 66 and the valve guide 68, so as to maintain the high pressure within the inlet and exhaust ports.

In order to better assure that the assembly of the seals 42, 62 and attached retainers 46, 66 are not over-installed over top of the corresponding valve guides 48, 68, corresponding retainer stops 82, 84 may be formed (for example, unitarily) in corresponding retainers 46, 66, as shown in FIGS. 3 and 4 respectively. Although the retainer stops 82, 84 may have various shapes, FIG. 3 illustrates the stop 82 to be of an inwardly directed sideway-oriented male U-shape that is formed within the retainer 46. The elastomeric seal 42 extends below the center of the stop 82. FIG. 4 illustrates the stop 84 to be of an outwardly directed shape (i.e., from its top portion to its lower portion), formed within the retainer 66. The shape of the stop 84 would be outwardly angular, possibly at 45°, to a valve guide shoulder 88.

The two stops 82, 84 are associated with corresponding valve guide shoulders 86, 88. Although these shoulders 86, 88 may have various shapes, FIGS. 3 and 4 show these shoulders 86, 88 being formed as female notches in the form of a step with respect to valve guides 48, 68. Upper horizontal surfaces 81, 83 of the respective shoulders 86, 88 are parallel to and formed radially inwardly toward respective valve stem shaft 50, 70 toward corresponding lower horizontal surfaces 85, 87. Each of the respective valve guide horizontal surfaces 81, 85 and 83, 87 are perpendicular to corresponding valve guide vertical surfaces 89, 91. Each of these valve guide vertical surfaces 89, 91 is formed radially inwardly from its respective shoulder 86, 88, so as to receive the corresponding stop 82, 84. As shown in FIG. 3, the elastomeric seal 42 may extend radially inwardly below the valve guide horizontal surface 81.

Consequently, each stop 82, 84 makes contact with its respective female shoulder 86, 88, at the uppermost point of the respective inward second vertical surface 53, 98, as respectively shown in FIG. 3, FIG. 4. As also shown in FIGS. 3 and 4, the valve guides 48, 68 are wider below the shoulders 86, 88 than above the shoulders 86, 88.

As the assemblies of the seals 42, 62, with attached retainers 46, 66, are being installed over the top of their respective valve guides 48, 68, the stops 82, 84 come into blocking contact with the shoulders 86, 88 on the valve guides 48, 68. As a result, the seals 42, 62, which are above the stops 82, 84, are prevented from being moved into a lower position farther down on the valve guide 48, 68.

As can be seen in FIG. 3, the seal 42 curves around the stop 82 and also protrudes inwardly along the upper outward horizontal surface 81, thereby better sealing off the passage of gases along the interface of the two surfaces 52, 57. Consequently, the stops 82, 84 prevent over-installation of the assemblies of the seals 42, 62, with attached retainers 46, 66, so as to maintain the pressure and engine gases within an inlet or exhaust port.

If, however, over-installation prevention is not desired, then the stops 82, 84 and the shoulders 86, 88 may not be required and the metal retainers 46, 66 may be disposed in a vertically straight orientation along their corresponding valve guide 48, 68.

However, as further shown in FIG. 4, with the stop 84 in place, there is a metal-to-metal grip at the valve guide second outward surface 96 provided in the valve stem seal assembly 60. These grip surface 96 is located more outwardly than the grip surface 76, below the stop 84. Consequently, the valve stem seal assembly 60 seal/grip the metal valve guide 68 off with added areas.

Figure 1:
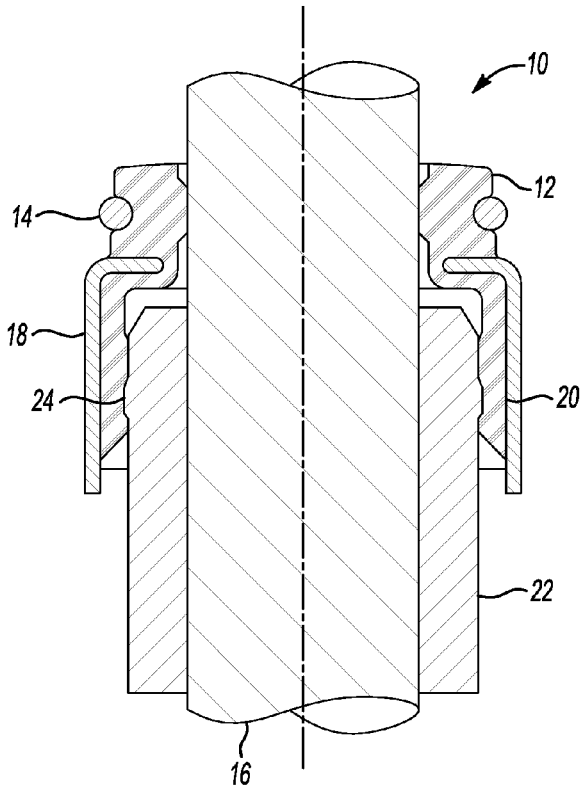
Fig-1 PRIOR ART
FIG. 1 is a cross sectional elevation view of a prior art side seal valve stem seal assembly.
Figure 2:
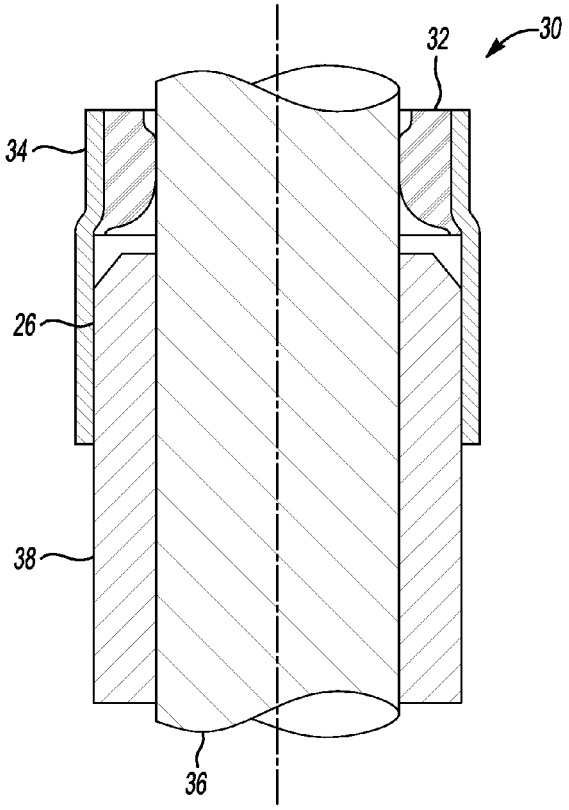
Fig-2 PRIOR ART
FIG. 2 is a cross sectional elevation view of a prior art top seal valve stem seal assembly.

This contrasts the single grip areas 24, 26 provided by prior art valve stem seal assemblies 10, 30, as shown in FIGS. 1 and 2. Hence, these seals/grips of the metal valve guides 48, 68 are accomplished while taking advantage of the elastomeric characteristics of the seals 42, 62 and the metal characteristics of the retainers 46, 66 to seal/grip the valve guides 48, 68.

In accordance with the provisions of the patent statutes, the principles and modes of operation of this invention have been described and illustrated in its preferred embodiments. However, it must be understood that the invention may be practiced otherwise than specifically explained and illustrated without departing from its spirit or scope.

What is claimed is:

1. A valve stem seal assembly, comprising:

an elastomeric seal;

a metal retainer having an upper and a lower inward vertical surfaces, with a continuous metal stop formed therebetween; and a metal valve guide in an elastomeric-to-metal seal with the elastomeric seal on a first outward vertical surface of the metal valve guide;

wherein the lower inward vertical surface of the metal retainer is in direct contact with a second outward vertical surface of the metal valve guide, and both the lower inward vertical surface of the metal retainer and the second outward vertical surface of the metal valve guide are below the stop, the stop in a block contact with a shoulder on the metal valve guide to prevent over-installation of the elastomeric seal and metal retainer, and the shoulder on the metal valve guide being above the lower portion of the metal retainer;

wherein further the metal valve guide has a third outward vertical surface inwardly separated between the first and second metal valve guide outward vertical surfaces, by first and second metal valve guide horizontal surfaces, the second metal valve guide outward vertical surface being below the third metal valve guide outward vertical surface, the third metal valve guide outward vertical surface does not contact the metal retainer at all, and the retainer stop extending down from, and the shoulder being at, the farthest radial extension of the second metal valve guide horizontal surface.

2. The valve stem seal assembly of claim 1, wherein the metal retainer is disposed within a side of the elastomeric seal.

3. The valve stem seal assembly of claim 2, wherein the elastomeric seal is attached to the upper inward vertical surface of the metal retainer.

4. The valve stem seal assembly of claim 2, further comprising a garter spring to apply a force radially inward on the elastomeric seal to seal the elastomeric seal to a valve stem shaft.

5. The valve stem seal assembly of claim 2, wherein the elastomeric seal comprises a sealing lip extending downwardly and simultaneously curving inwardly from just below where the metal retainer is disposed within the side of the elastomeric seal to seal the elastomeric seal to a valve stem shaft.

6. The valve stem seal assembly of claim 2, wherein the elastomeric seal extends inwardly below the first valve guide horizontal surface.

7. The valve stem seal assembly of claim 2, wherein the elastomeric seal extends below the center of the retainer stop.

8. The valve stem seal assembly of claim 2, wherein the retainer stop is shaped as an inwardly directed sideway-oriented male U-shape formed within the retainer.

9. The valve stem seal assembly of claim 1, wherein the elastomeric seal is disposed on the upper inward vertical surface of the metal retainer at a top of a valve stem seal assembly and in an elastomeric-to-metal seal with the metal retainer.

10. The valve stem seal assembly of claim 9, wherein the elastomeric seal in an elastomeric-to-metal seal with the metal valve guide toward the top of the metal valve guide and the first outward vertical surface of the metal valve guide is in a second metal-to-metal grip with the first inward vertical surface of the metal retainer, down to the first horizontal surface of the metal valve guide.

11. The valve stem seal assembly of claim 10, wherein the elastomeric seal is installed no lower than a chamfer on a top corner of the metal valve guide.

12. The valve stem seal assembly of claim 9, wherein the retainer stop has an outwardly directed angular shape from a top portion of the stop to a lower portion thereof.

13. The valve stem seal assembly of claim 9, wherein the elastomeric seal comprises a sealing lip extending downwardly and simultaneously curving inwardly from just above a top of the metal valve guide to seal the elastomeric seal to a valve stem shaft, and the metal valve guide is in an elastomeric-to-metal seal with the elastomeric seal, at the top of the metal valve guide, where a lower extension of the seal is in an elastomeric-to-metal seal with a chamfer on a top corner of the valve guide.

* * * * *